US005562217A

United States Patent [19]

Salveson et al.

[11] Patent Number: 5,562,217

[45] Date of Patent: Oct. 8, 1996

[54] PUSHER UNIT FOR DISPENSING MERCHANDISE

[75] Inventors: Gerald O. Salveson, Lodi, Wis.; Bernard Primiano, Smyrna, Ga.; Edmond B. Reinagel, Social Circle, Ga.; Dennis E. Parham, Kennesaw, Ga.

[73] Assignee: The Mead Corporation, Dayton, Ohio

[21] Appl. No.: 332,559

[22] Filed: Oct. 31, 1994

[51] Int. Cl.[6] ..... A47F 1/00; A47F 7/00

[52] U.S. Cl. ..... 211/59.3; 211/51; 211/175; 312/71

[58] Field of Search ..... 211/59.3, 51, 175; 312/61, 71

[56] References Cited

U.S. PATENT DOCUMENTS

| | | | |
|---|---|---|---|
| D. 330,121 | 10/1992 | Wear et al. | D6/408 |
| 3,028,014 | 4/1962 | Southwick | 211/51 X |
| 3,083,067 | 3/1963 | Vos et al. | 312/71 |
| 3,161,295 | 12/1964 | Chesley | 211/49 |
| 3,308,961 | 3/1967 | Chesley | 211/49 |
| 3,848,745 | 11/1974 | Smith | 211/49 |
| 4,303,162 | 12/1981 | Suttles | 211/49 D |
| 4,454,949 | 6/1984 | Flum | 211/49 D |
| 4,729,481 | 3/1988 | Hawkinson et al. | 211/59.3 |
| 4,730,741 | 3/1988 | Jackle, III et al. | 211/59.3 |
| 4,762,236 | 8/1988 | Jackle, III et al. | 211/59.3 |
| 4,830,201 | 5/1989 | Breslow | 211/184 |
| 4,898,282 | 2/1990 | Hawkinson et al. | 211/49.1 |
| 4,899,893 | 2/1990 | Robertson | 211/59.3 |
| 4,901,869 | 2/1990 | Hawkinson et al. | 211/59.3 |
| 4,997,094 | 3/1991 | Spamer et al. | 211/175 X |
| 5,012,936 | 5/1991 | Crum | 211/59.3 |
| 5,027,957 | 7/1991 | Skalski | 211/59.3 |
| 5,069,349 | 12/1991 | Wear et al. | 211/59.3 |
| 5,111,942 | 5/1992 | Bernardin | 211/59.3 |
| 5,123,546 | 6/1992 | Crum | 211/59.3 |

OTHER PUBLICATIONS

Photos of device observed in Harry's Farmers Market in Duluth, Georgia in Mar., 1995.

*Primary Examiner*—Alvin C. Chin-Shue
*Assistant Examiner*—Brian J. Hamilla
*Attorney, Agent, or Firm*—Needle & Rosenberg, P.C.

[57] ABSTRACT

A pusher unit for placement into a merchandise display tray to dispense merchandise which has an elongated shelving track with a front end and a top surface for carrying the bottom surface of the merchandise. The pusher unit has a spring-biased pusher plate with a front surface for contacting the side surface of the merchandise. The bottom section of the pusher plate is movable along the top surface of the shelving track so that the front surface of the pusher plate engages the side surface of the merchandise and the merchandise is thereby disposed between the pusher plate and the front end of the shelving track. The pusher plate has interconnected upper and lower sections with the upper section being movable between a merchandise-dispensing position and a merchandise-loading position. When the upper section is in the merchandise-loading position, the front surface of the upper section of the pusher plate is out of the plane defined by the front surface of the lower section. The pusher plate can be locked into a selective position along the shelving track to facilitate loading merchandise on the shelving track in front of the pusher plate. An improved shelf for dispensing merchandise is also provided, which has a shelving track removably attached to the merchandise display tray.

26 Claims, 5 Drawing Sheets

PUSHER UNIT FOR DISPENSING MERCHANDISE

BACKGROUND OF THE INVENTION

1. Field of the Invention

The present invention relates to the field of improved retail merchandise display assemblies which are adapted to dispense merchandise from the front. More particularly, the invention concerns a retrofit pusher unit for placement into an existing merchandise display tray.

2. Description of Related Art

Retail merchandising requires that items for sale to individuals be arranged in a display such that they are attractive and readily accessible to the customer by being easily identified and within reach. Typically, customers will take the forward-most items from a display, leaving the rearward items which are not easily visible or are harder to reach. Furthermore, the items for sale must be maintained in an organized manner for the convenience of subsequent customers. A merchandise display must also be readily adaptable for restocking merchandise. In addition, to provide a maximum selection for customers, the goods must be compactly arranged in displays which maximize the available shelf display space.

Many useful merchandiser assemblies are available which provide an organized display for goods to move consecutively to the front of the assembly by gravitational force when each item is removed from the front. Examples of such gravity fed display devices may be found in U.S. Pat. No. 5,050,748 to Taub, U.S. Pat. No. 4,958,739 to Spamer, U.S. Pat. No. 4,785,945 to Rowse et al., and U.S. Pat. No. 4,460,096 to Ricci. These devices generally require tilting the display shelf at an angle, which results in an increased likelihood for accidentally breaking the merchandise. When stacked upon each other, these models also waste potential display space beneath the uptilted end of the lowest stacked shelve and above the lower end of the uppermost shelf.

In order to conserve available display space, especially in a temperature controlled environment such as a refrigerator, and to reduce the likelihood of damaged goods, it is preferable to use a simple mechanism, such as a spring, to feed the merchandise forward, rather than relying upon the above gravity feeder designs. Examples of such display assemblies may be found in U.S. Pat. No. 5,123,546 to Crum, U.S. Pat. No. 5,111,942 to Bernardin, U.S. Pat. No. 5,069,349 to Wear et al., U.S. Pat. No. 5,027,957 to Skalski, U.S. Pat. No. 5,012,936 to Crum, U.S. Pat. No. 4,901,869 to Hawkinson et at., U.S. Pat. No. 4,899,893 to Robertson, U.S. Pat. No. 3,848,745 to Smith, U.S. Pat. No. 3,308,961 to Chesley, the contents of which are all hereby incorporated by reference. However, existing mechanical display trays are only provided in a complete assembly required for total display shelf replacement. Furthermore, current display tray devices are not structured for the convenient restocking of merchandise.

Therefore, it is an object of the present invention to provide an economical retrofit merchandise pusher unit for placement into an existing merchandise display tray which can advance items consecutively forward when the front item is removed.

It is a further object to provide a device with a pusher plate which automatically advances merchandise items forward, and which has a pusher element which is movable between a merchandise-dispensing position and a merchandise-loading position.

Another object of the invention is to provide an improved shelf for dispensing merchandise which has been retrofitted with a merchandise pusher unit.

SUMMARY OF THE INVENTION

The present invention provides a pusher unit for placement into a merchandise display tray to dispense articles of merchandise. The pusher unit includes an elongated shelving track with a front end and a top surface for carrying the bottom surface of the merchandise. The pusher unit also has a pusher plate with a front surface for contacting the side surface of the merchandise. The pusher plate is movable along the top surface of the shelving track so that the front surface of the pusher plate engages the side surface of the merchandise, and the merchandise is thereby disposed between the pusher plate and the front end of the shelving track. The pusher plate also has a means for biasing the pusher plate toward the front end of the track to dispense merchandise.

The invention additionally provides a means interconnecting upper and lower sections of the pusher plate, such as a hinge, so that the upper section is movable between a merchandise-dispensing position and a merchandise-loading position. The front surfaces are oriented such that when the upper section is in the merchandise-dispensing position, the front surface of the lower section and the front surface of the upper section of the pusher plate define a plane. When the upper section is in the merchandise-loading position, the front surface of the upper section of the pusher plate is out of the plane and disposed away from the front end of the shelving track.

The biasing means is a metal roll spring and the exterior surface of the coiled body portion of the roll spring engages the rear surface of the lower section of the pusher plate. This configuration normally urges the pusher plate toward the front end of the shelving track to dispense merchandise. A means for selectively locking the pusher plate in a biased position along the shelving track is also provided to facilitate loading merchandise on the shelving track in front of the pusher plate.

The present invention also provides an improved shelf for dispensing merchandise, which has a shelving track removably attached to the merchandise display tray. The shelving track can further have an attachment means for removably securing the shelving track to the floor of the merchandise display tray.

DETAILED DESCRIPTION OF THE INVENTION

The present invention may be understood more readily by reference to the following detailed description of the specific embodiments.

Figure 1:
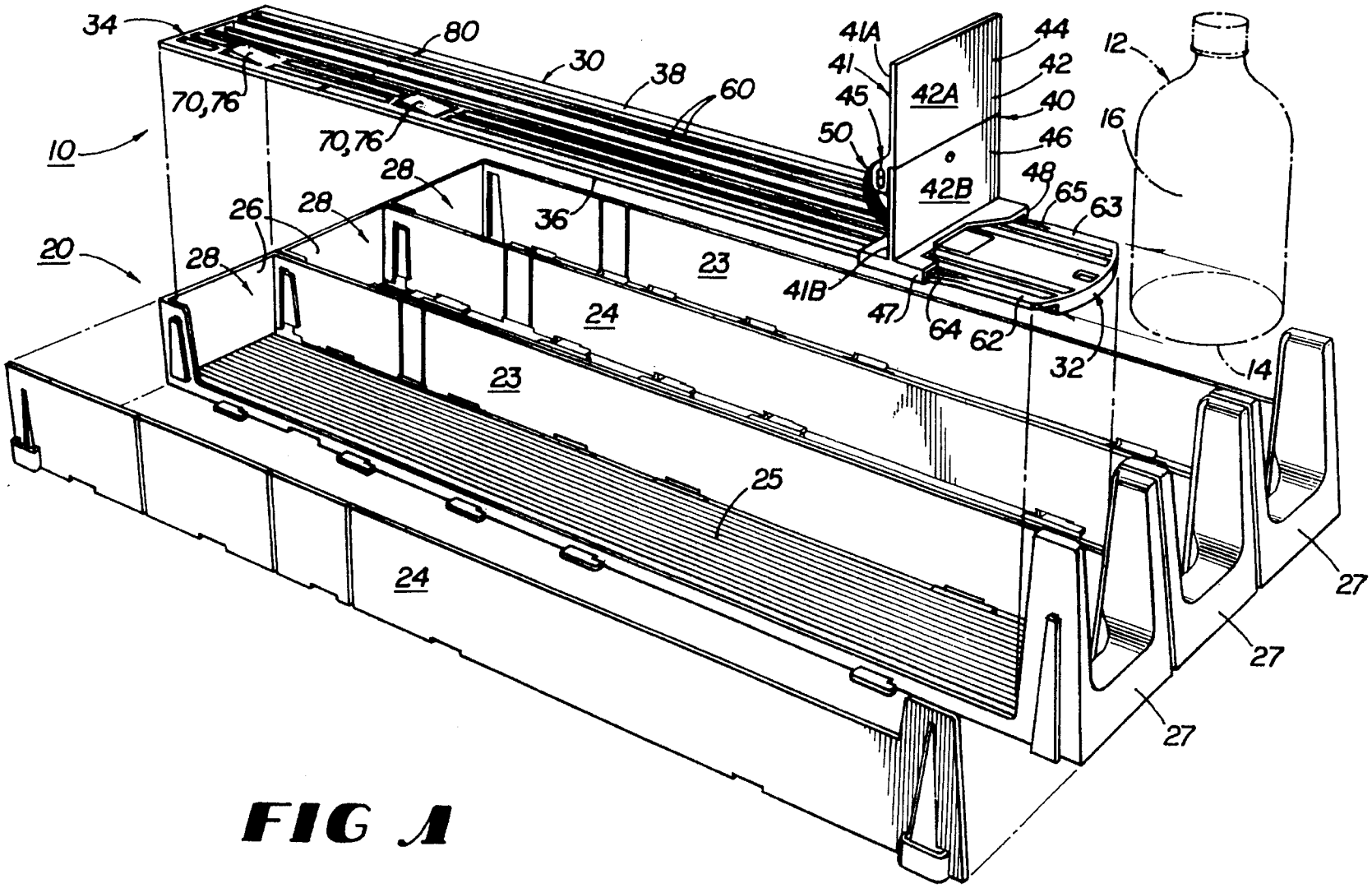
FIG. 1 is a front perspective view of the pusher unit of present invention exploded away from a merchandise display tray.
Figure 2:
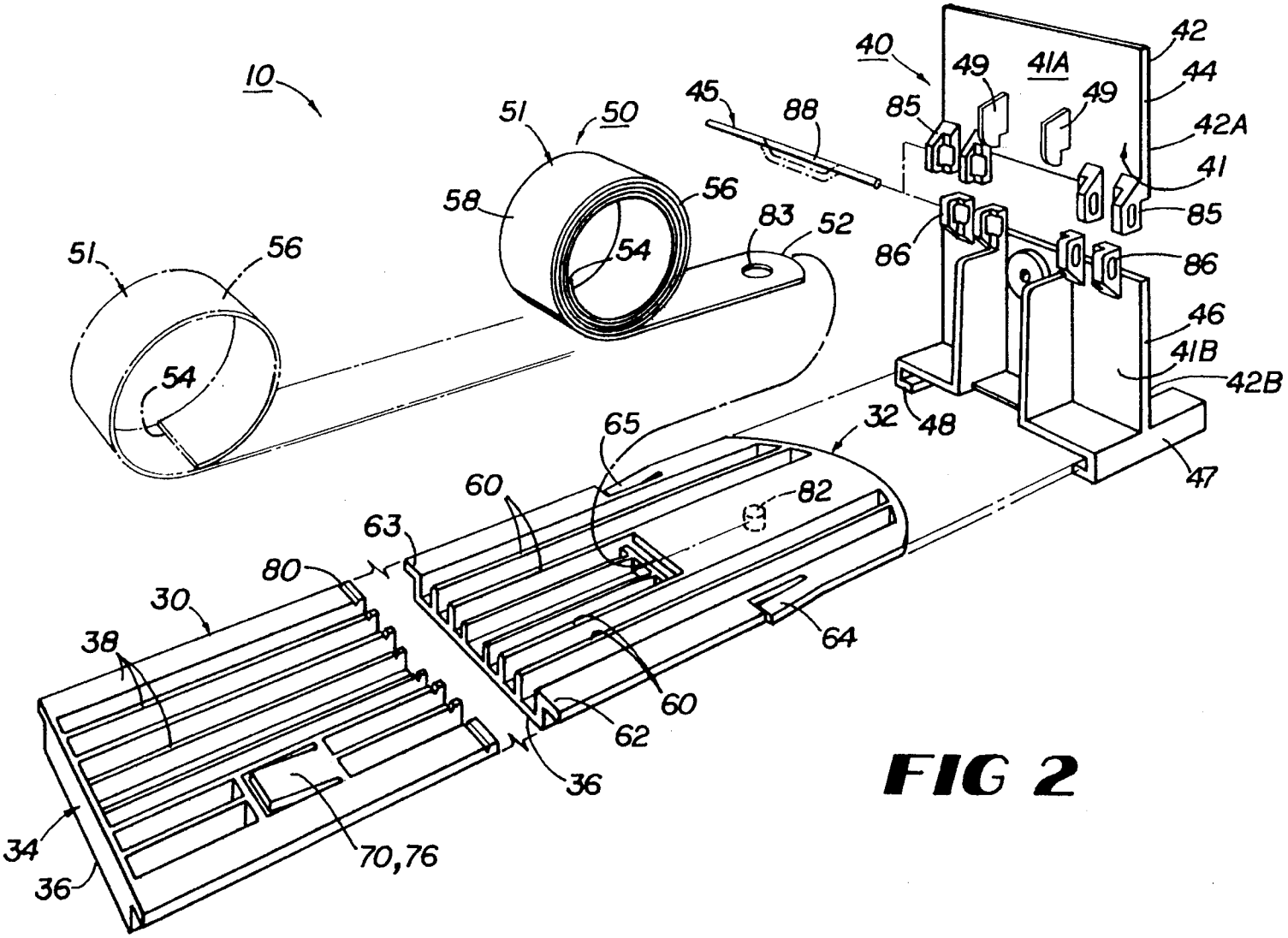
FIG. 2 is a rear perspective view of the pusher unit of the present invention with certain parts exploded away for clarity.

Referring to FIGS. 1 and 2, a pusher unit 10 is provided for placement into a merchandise display tray 20 to dispense articles of merchandise 12. The article or merchandise 12 has a bottom surface 14 and at least one upstanding side surface 16. An elongated shelving track 30 is provided with a front end 32, and opposite rear end 34, a lower surface 36 and a top surface 38 for carrying the bottom surface 14 of the merchandise 12. The shelving track 30 is of a size sufficient to retain the saleable merchandise 12 in tandem in a longitudinally disposed row and of a width sufficient to insert into conventional pre-existing merchandise display trays 20.

The shelving track 30 can be inserted into existing flat bottomed gravity feed type display trays or into display trays from which an undesirable merchandise advancing system has been removed. The shelving track 30 is preferably constructed of plastic or other resilient, inexpensive materials. The shelving track 30 can be provided with ribs 60 on the top surface 38 thereof, for engagement of the bottom surface 14 of the merchandise 12 to minimize frictional resistance as the merchandise 12 moves therealong.

A pusher plate 40 has a rear surface 41 and a front surface 42 for contacting the side surface of the merchandise 12. The pusher plate 40 is movable along the top surface 38 of the shelving track 30 so that the front surface 42 of the pusher plate 40 engages the side surface 16 of the merchandise 12 and the merchandise 12 is thereby disposed between the pusher plate 40 and the front end 32 of the shelving track 30. A means 50 for biasing the pusher plate 40 toward the front end 32 of the shelving track 30 is provided to dispense merchandise 12.

Figure 3A:
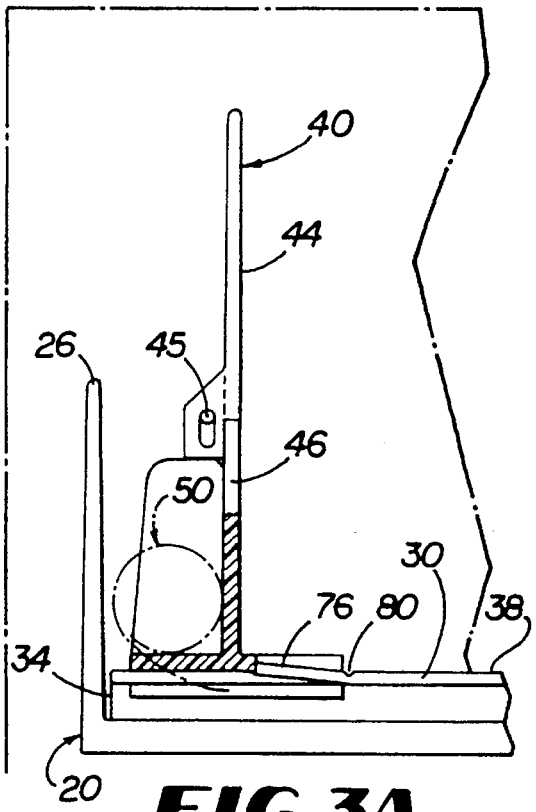
FIGS. 3A–3D are side partial elevational views of the pusher unit of the present invention with the upper section thereof moveable between its respective positions.
Figure 3C:
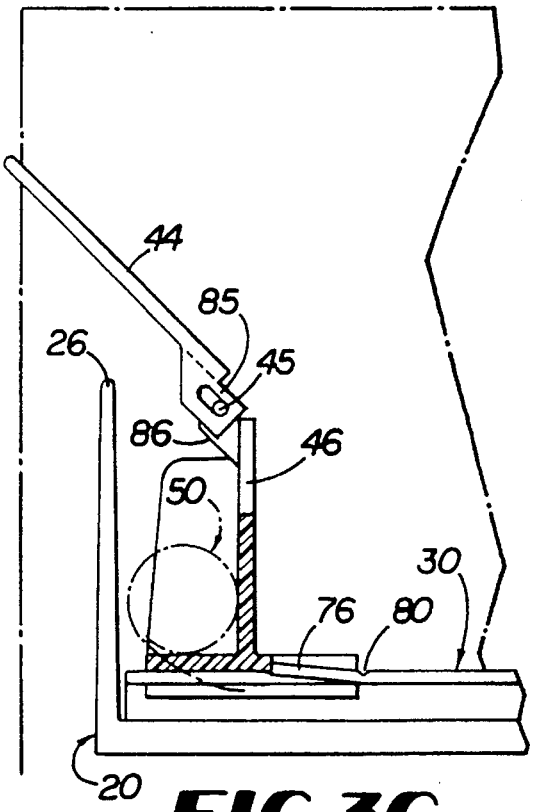
Figure 3B:
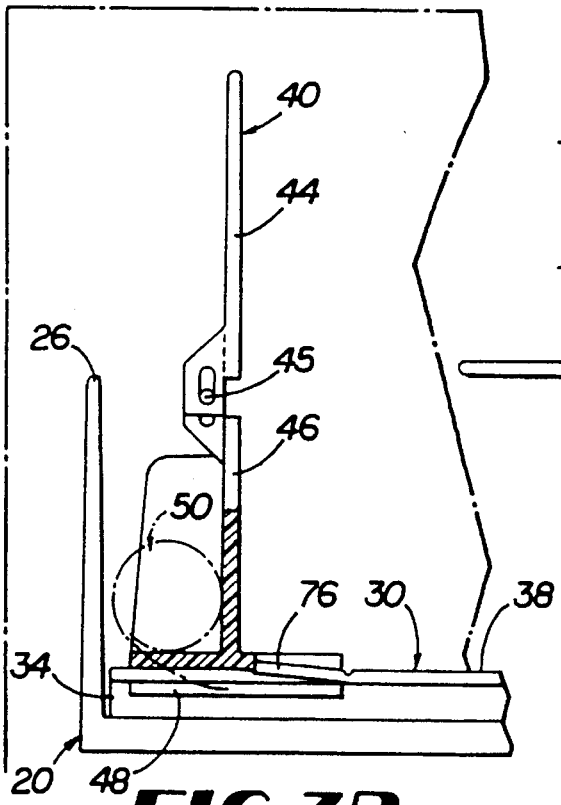
Figure 3D:
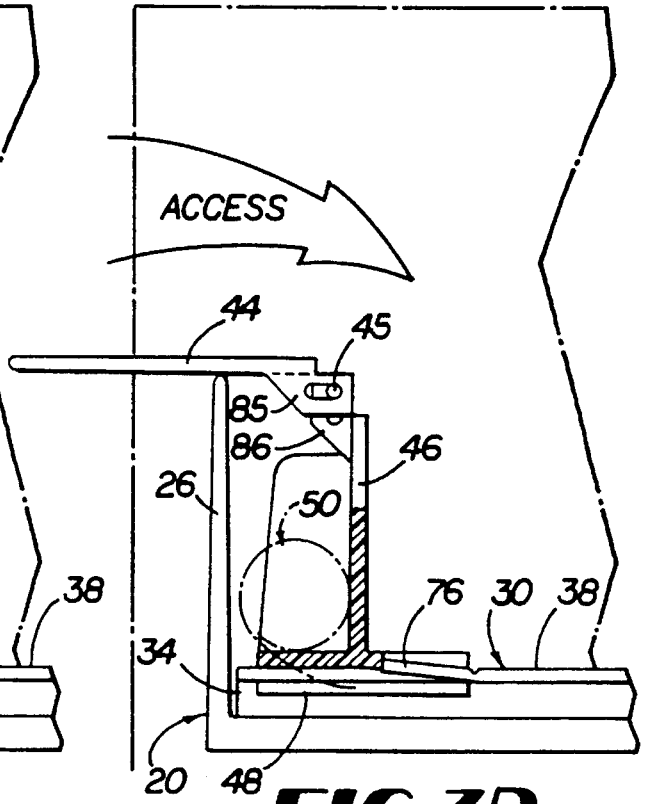

The pusher plate 40 comprises upper 44, lower 46 and bottom 43 sections. The upper and lower sections each have a front 42A, 42B and a rear surface 41A and 41B. A means 45 interconnecting the sections 44, 46 is provided so that the upper section 44 is movable between a merchandise-dispensing position and a merchandise-loading position, as seen in FIGS. 3A and 3D, respectively. The front surfaces 42A, 42B of the pusher plate sections 44, 46 are oriented such that when the upper section 44 is in the merchandise-dispensing position, the front surface 42B of the lower section 46 and the front surface 42A of the upper section 44 of the pusher plate 40 define a vertical plane. When the upper section 44 is moved in the merchandise-loading position, the front surface 42A of the upper section 44 of the pusher plate 40 is out of that plane (FIG. 3D). The merchandise-loading position, therefore, provides an advantage of the present invention by permitting the upper section 44 of the pusher plate 40 to be disposed out of the way for situations where merchandise 12 is to be loaded from the rear end 34 of the shelving track 30.

Referring to FIG. 2, a hinge 45, such as a "sloppy" hinge, provides an interconnecting means to permit the upper section 44 of the pusher plate 40 to selectively fold away from the front end 32 of the shelving track 30. As mentioned, the upper section 44 of the pusher plate 40 is disposed away from the front end 32 of the shelving track 30 when the pusher plate 40 is in the merchandise-loading position. This permits more convenient reloading of the merchandise 12 on the shelving track 30 in front of the pusher plate 40. The hinge 45 can also permit the upper section 44 of the pusher plate 40 to be disposed toward the front end 32 of the shelving track 30 to add versatility.

As shown in FIGS. 2 and 3, the sloppy hinge 45 has a hinge pin 88 and elongated receiving hinge knuckles 85, 86 on the upper section 44 and the lower section 46 of the pusher plate 40, respectively. The hinge pin 88 can have a bend in the middle portion thereof for maintaining the pin 88 within the hinge knuckles 85, 86. When in the merchandise-dispensing position (FIG. 3A), the hinge pin 88 abuts the upper interior surface of the elongated receiving hinge knuckle 85 of the upper section 44 and abuts the lower interior surface of the elongated receiving hinge knuckle 86 of the lower section 46. The merchandise-dispensing position is maintained, in part, by the contact between the forward surface of the elongated receiving hinge knuckle 85 of the upper section 44 against the rear surface 41B of the lower section 46 of the pusher plate 40. The merchandise-dispensing position is further maintained, in part, by the contact between the forward surface of the elongated receiving hinge knuckle 86 of the lower section 46 against the rear surface 41A of the upper section 44. The pusher plate 40 is moved to the merchandise-loading position by lifting the upper section 44 vertically upwards to disengage said contact points of said knuckles 85, 86 and then lowering the top section 44 toward the rear end 34 of the shelving track 30. In the merchandise-loading position (FIG. 3D), thus, the hinge pin 88 abuts the lower interior surface of the elongated receiving hinge knuckle 85 of the upper section 44 and abuts the upper interior surface of the elongated receiving hinge knuckle 86 of the lower section 46.

In one embodiment, the pusher plate 40 is equipped with clips 49 on the upper section 44 thereof for maintaining the pusher plate 40 in the merchandise-dispensing position. When the upper section 44 is in the merchandise-dispensing position, the clips 49 thereon brace against the rear surface 41B of the lower section 46. To move the upper section 44 to the merchandise-loading position, the upper section 44 is first lifted vertically in the above-mentioned plane to release the clips 49 from contacting the lower section 46, then the upper section 44 may be folded either toward the front end 32 or the rear end 34 of the shelving track 30.

When positioned between the pusher plate 40 and the from end 32 of the shelving track 30, the biasing means 50 allows articles to be automatically fed one after another toward the front end 32 as leading articles 12 are successively removed. The biasing means 50 is illustrated as a roll spring 51 which has a first end 52, an opposed second end 54 and an intermediate coiled body portion 56.

The coiled body portion 56 of the roll spring 51 has an exterior surface 58. A lug hole 83 on the first end 52 of the roll spring 51 is secured to the lower surface 36 of the shelving track 30 to a mounting lug 82 adjacent the front end 32 thereof. The exterior surface 58 of the coiled body portion 56 of the roll spring 51 engages the rear surface 41B of the lower section 46 of the pusher plate 40. This configuration normally urges the pusher plate 40 toward the front end 32 of the shelving track 30 to dispense merchandise 12.

Figure 4:
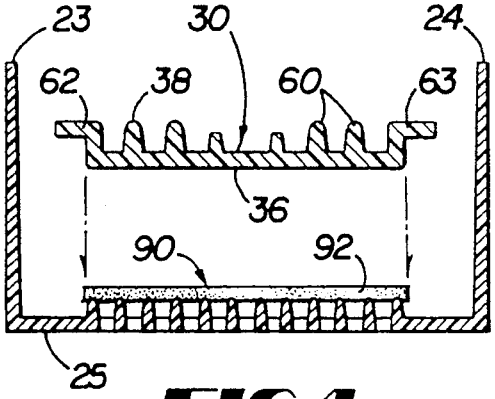
FIG. 4 is an end elevational view in vertical cross-section of the one means of attaching the shelving track to the merchandise display tray of the present invention.
Figure 5:
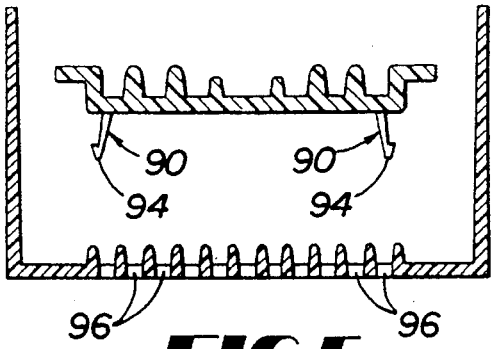
FIG. 5 is an end elevational view in vertical cross-section of an alternative means of attaching the shelving track to the merchandise display tray of the present invention.

In this configuration, the roll spring biasing means 50 is disposed within a recess in the top surface 38 of the shelving track 30 in front of the pusher plate 40, thereby avoiding any interference with the bottom surface 14 of the merchandise 12. As seen in FIGS. 4 and 5, the recess is defined by the height differential between the two centrally disposed ribs 60 and the adjacent ribs 60. The two central ribs 60 are shorter in height than the adjacent ribs 60, thus, allowing the extended roll spring biasing means 50 to rest within the resulting recess and out of the way of the merchandise 12.

Alternatively, the invention contemplates that the biasing means can be a coiled spring (not shown) of the type shown in U.S. Pat. No. 5,111,942 to Bernardin or in U.S. Pat. No. 4,901,869 to Hawkinson et al., which are incorporated by reference. Such a biasing means has opposed first and second ends attached to the shelving track adjacent the rear end thereof. The middle portion of the coil spring is attached to the pusher plate, which is directed to the front end of the shelving track by direction-changer pulley wheels. This configuration thus also normally urges the pusher plate toward the front end of the shelving track to dispense merchandise.

As seen in FIGS. 1 and 2, the shelving track 30 can be provided with opposed longitudinal side edges 62, 63 and the bottom section 43 of the pusher plate 40 can be correspondingly equipped with a pair of inwardly directed and opposed channel members 47, 48. The channel members 47, 48 are adapted to receive therein the side edges 62, 63 of the shelving track 30 so as to allow the pusher plate 40 to slide along the length of the shelving track 30. The shelving track 30 is also equipped with outwardly directed flanges 64, 65 extending along each side edge 62, 63 of the shelving track 30 near the front end 32 thereof. The flanges 64, 65 act as depressible stops to selectively prevent the channel members 47, 48 from passing thereover in the forward direction.

Figure 6:
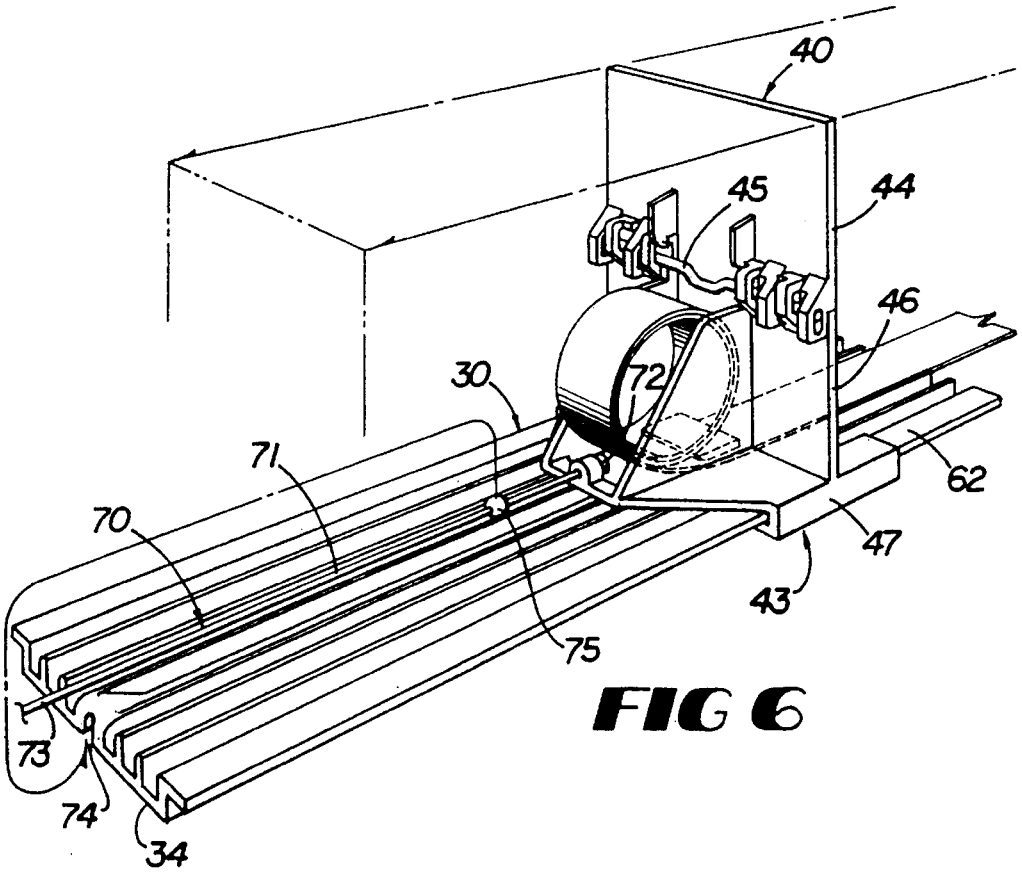
FIG. 6 is a rearward perspective view of the pusher unit and draw string locking means of the present invention.

A means 70 for selectively locking the pusher plate 40 in a biased position along the shelving track 30 is provided to facilitate loading merchandise 12 on the shelving track 30 in front of the pusher plate 40. As seen in FIG. 6, the means 70 for selectively locking the pusher plate 40 can have a draw string 71 with a first end 72 connected to the pusher plate 40 and a second end 73 for pulling the pusher plate 40 away from the front end 32 of the shelving track 30 against the biasing means 50 so as to allow loading merchandise 12 on the top surface 38 of the shelving track 30 in front of the pusher plate 40.

Additionally, as seen in FIG. 6, the means 70 for selectively locking the pusher plate 40 can have a notch 74 on the rear end 34 of the shelving track 30 for receiving therein the draw string 71. The draw string 71 is equipped with a protrusion 75, such as a bead, adjustably affixed thereon. When the draw string 71 is pulled toward the rear end 34 of the shelving track 30 and inserted into the notch 74, the protrusion 75 will selectively secure the draw string 71 and lock the pusher plate 40 in the biased position so as to allow the loading of merchandise 12 onto the top surface 38 of the shelving track 30 in front of the pusher plate 40.

As seen in FIGS. 1 and 2, the locking means 70 can also be in the form of a flexible tab portion 76 in the shelving track 30 adapted so as to move between a plane defined by the top surface 38 of the shelving track 30, so as to allow the pusher plate 40 to travel thereover when travelling away from the front end 32 of the shelving track 30, and above the plane. When the tab portion 76 is above the plane of the top surface 38, it locks the pusher plate 40 in the biased position behind the flexible tab portion 76 for loading merchandise 12 on the top surface 38 of the shelving track 30 in front of the pusher plate 40 (FIGS. 3A–3D). Normally, the tab portion 76 is in the position above the plane of the top surface 38.

As seen in FIGS. 1 and 2, the pusher unit 10 can be further constructed with a means 80 extending transversely across the elongated shelving track 30 at an intermediate location between the front end 32 and the rear end 34 for weakening the shelving track 30. This weakening means 80 permits the shelving track 30 to be broken along the weakening means 80 into separate front and rear portions to allow the merchant to adjust the length of the shelving track 30 to fit within an existing display tray 20. The weakening means 80 is generally a perforation or slight indentation in the shelving track 30. There may be more than one such perforation along the shelving track 30.

The present invention also provides an improved shelf for dispensing merchandise 12, which has a shelving track 30 removably attached to the merchandise display tray 20. The elongated shelving track 30 has a lower surface 36 which is removably affixed to the merchandise display tray 20. The merchandise display tray 20 generally has a pair of opposing side walls 23, 24 along opposite side edges, a floor 25, an end wall 26 and an opposed front wall 27. The floor 25 and side walls 23, 24 define a channel 28 for receiving in tandem a row of merchandise or articles 12 for movement along the channel 28. The side walls 23, 24 of the display tray have upper and lower edges. As shown in FIG. 1, the lower edges of the sidewalls are disposed along the side edges of the floor.

The shelving track 30 can further have an attachment means 90 for removably securing the shelving track 30 to the floor 25 of the merchandise display tray 20. In one embodiment, as seen in FIG. 4, the attachment means 90 is a piece of double sided foam cushioned tape 92. In another embodiment as seen in FIG. 5, the attachment means 90 is a flexible cleat 94 depending from the shelving track 30 which is in registry with a slot 96 in the floor 25 of the merchandise display tray 20 for selective insertion therein and removal therefrom.

Figure 7:
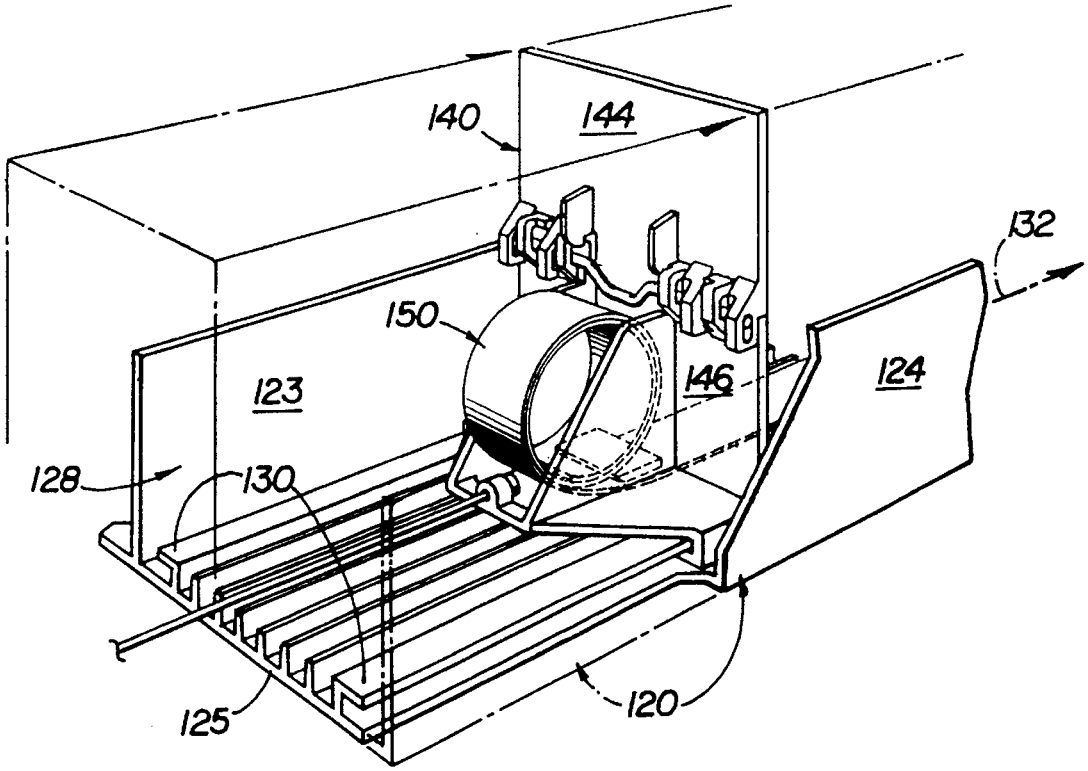
FIG. 7 is a rearward perspective view of a merchandise display shelf with an integral shelving track for sliding movement of an article pusher plate of the present invention.
Figure 8:
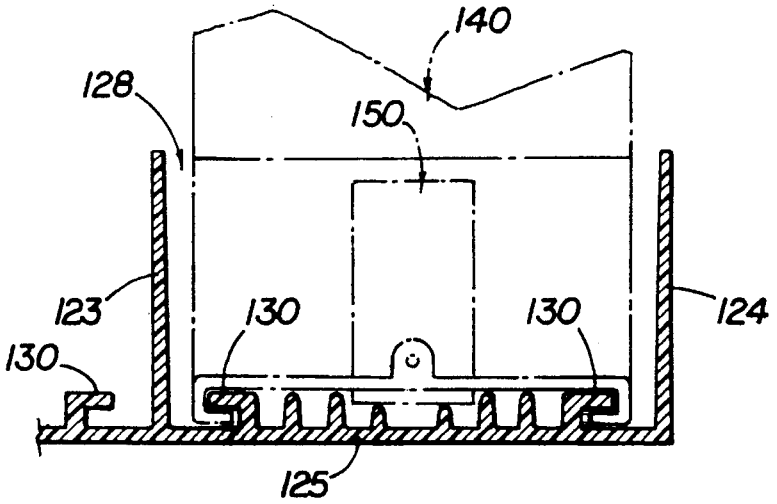
FIG. 8 is an end elevational view in vertical cross-section of the display shelf with integral shelving track and pusher plate of the present invention.

FIGS. 7 and 8 show an alternative embodiment of a merchandise display shelf of the present invention which has an integral shelving track 130 formed therewith. This merchandise display shelf comprises a display tray 120 having a floor 125 and opposite side walls 123, 124. The floor 125 and side walls 123, 124 define a channel 128 for receiving in tandem a row of merchandise or articles (not shown) for movement along the channel 128. The floor 125 comprises a shelving track 130 formed integrally therewith and extending along said channel 128. A pusher plate 140 is connected to the shelving track 130 for sliding movement therealong and has upper and lower section 144, 146 which is movable between a merchandise-dispensing and a merchandise-loading position. The merchandise display tray 120 with integral shelving track 130 also has a biasing means 150 for biasing the pusher plate 140 forward to dispense merchandise from the front end 132 thereof.

These and other features and embodiments of the invention will be apparent to those skilled in the art.

What is claimed is:

1. An improved shelf for dispensing merchandise, the merchandise having a bottom surface and at least one upstanding side surface, comprising:

a. a merchandise display tray comprising a pair of opposing side walls and a floor;

b. an elongated shelving track comprising a front end and a top surface for carrying the bottom surface of the merchandise, the shelving track being removably disposed on the floor of the display tray;

c. a pusher plate including an upper section, a lower section and a bottom section, the bottom section being connected to the shelving track for sliding movement therealong, the upper and lower sections each having a from surface for engaging the side surface of the merchandise, the lower section extending upward from the bottom section, the upper section being connected to the lower section by interconnecting means so as to be movable between a merchandise-dispensing position and a merchandise-loading position, the front surfaces of the pusher plate being oriented such that when the upper section is in the merchandise-dispensing position, the front surface of the lower section and the front surface of the upper section define a plane, and when the upper section is in the merchandise-loading position, the front surface of the upper section is out of said plane disposed away from the front end of the shelving track; and, d. means for biasing the pusher plate toward the front end of the track to dispense merchandise.

2. The improved shelf for dispensing merchandise of claim 1, wherein the interconnecting means comprises a hinge to permit the upper section of the pusher plate to selectively fold away from the front end of the shelving track.

3. The improved shelf for dispensing merchandise of claim 1, wherein the biasing means comprises a first end and an opposed second end, the first end being attached to the front end of the shelving track and the pusher plate being disposed between the first and second ends, whereby the pusher plate is biased toward the front of the shelving track to dispense merchandise.

4. The improved shelf for dispensing merchandise of claim 1, wherein the lower section of the pusher plate further comprises a rear surface opposite the front surface, and wherein the biasing means comprises a roll spring having opposed first and second ends and a coiled body portion therebetween, the coiled body portion having an exterior surface, wherein the first end of the roll spring is secured to the shelving track adjacent the front end thereof and wherein the exterior surface of the coiled body portion of the roll spring engages the rear surface of the lower section of the pusher plate so as normally to urge the pusher plate toward the front end of the shelving track to dispense merchandise.

5. The improved shelf for dispensing merchandise of claim 1, wherein the elongated shelving track further comprises opposed longitudinal side edges, and the bottom section of the pusher plate comprises a pair of inwardly directed and opposed channel members disposed thereon adapted to receive therein the side edges of the shelving track so as to allow the pusher plate to slide along the length of the shelving track.

6. The improved shelf for dispensing merchandise of claim 1, further comprising a means for selectively locking the pusher plate in a biased position along the shelving track to facilitate loading merchandise on the shelving track in front of the pusher plate.

7. The improved shelf for dispensing merchandise of claim 6, wherein the means for selectively locking the pusher plate comprises a draw string with a first end connected to the pusher plate and a second end for pulling the pusher plate away from the front end of the shelving track against the biasing means so as to allow the loading of merchandise on the top surface of the shelving track in front of the pusher plate.

8. The improved shelf for dispensing merchandise of claim 7, wherein the shelving track further comprises a rear end opposite the front end and the means for selectively locking the pusher plate further comprises a notch on the rear end of the shelving track for receiving therein the draw string, the draw string further comprising a protrusion adjustably affixed thereon such that when the draw string is pulled toward the rear of the shelving track and inserted into the notch, the protrusion will selectively secure the draw string and lock the pusher plate in the biased position so as to allow loading merchandise on the top surface of the shelving track in front of the pusher plate.

9. The improved shelf for dispensing merchandise of claim 1, wherein the shelving track further comprises a rear end opposite the front end, and further comprising means extending transversely across the elongated shelving track at an intermediate location between the front end and the rear end for weakening the shelving track whereby the shelving track can be broken along the weakening means into separate front and rear portions.

10. The improved shelf for dispensing merchandise of claim 1, wherein the shelving track further comprises an attachment means for removably securing the shelving track to the floor of the merchandise display tray.

11. The improved shelf of claim 10, wherein the attachment means comprises a portion of double-sided tape positioned between the shelving track and the floor of the merchandise display tray for selective attachment thereto.

12. The improved shelf for dispensing merchandise of claim 10, wherein the attachment means comprises a cleat depending from the shelving track which is in registry with a slot in the floor of the merchandise display tray for selective insertion therein and removal therefrom.

13. A merchandise display shelf comprising:

a. a display tray having a floor and opposite side walls, said floor and said side walls defining a channel for receiving in tandem a row of articles for movement along said channel;

b. a shelving track removably placed in said tray and extending along said channel, said shelving track having a front end and being disposed to movably support articles when articles are received in said channel;

c. an article pusher plate including an upper section, a lower section and a bottom section, said bottom section being connected to said shelving track for sliding movement therealong, said upper and lower sections each having a front surface for engaging articles supported on said shelving track, said lower section extending upward from said bottom section, said upper section being pivotally connected to said lower section for movement between an article-dispensing position where said front surface of said upper section lies in the plane of said front surface of said lower section and an article-loading position where said front surface of said upper section lies outside said plane and is disposed away from the front end of said shelving track; and, d. means for biasing said pusher plate forward of said shelving track so that when positioned in said channel between said pusher plate and said front end, said pusher plate is adapted to allow articles to be automatically fed one after another toward said front end as leading articles in said channel successively are removed from said channel.

14. The display shelf of claim 13, further comprising an attachment means for removably securing the shelving track to the floor of the display tray.

15. The display shelf of claim 14, wherein the attachment means comprises a portion of double-sided tape positioned between the shelving track and the floor of the display tray for selective attachment thereto and removal therefrom.

16. The display tray of claim 14, wherein the attachment means comprises a cleat depending from the shelving track which is in registry with a slot in the floor of the display tray for selective insertion therein and removal therefrom.

17. The display shelf of claim 13, wherein the floor of the display tray has a pair of opposite side edges, each of the side walls of the display tray has upper and lower opposed edges, and the lower edges of the side walls are disposed respectively along the opposite side edges of the floor.

18. A merchandise display shelf comprising:

a. a display tray having a floor and opposite side walls, said floor and said side walls defining a channel for receiving in tandem a row of articles for movement along said channel, said floor comprising a shelving track formed integrally therewith and extending along said channel, said shelving track having a front end and being disposed to support articles for said movement;

b. an article pusher plate including an upper section, a lower section and a bottom section, said bottom section being connected to said shelving track for sliding movement therealong, said upper and lower sections each having a front surface for engaging articles supported on said shelving track, said lower section extending upward from said bottom section, said upper section being pivotally connected to said lower section for movement between an article-dispensing position where said front surface of said upper section lies in the plane of said front surface of said lower section and an article-loading position where said front surface of said upper section lies outside said plane and is disposed away from the front end of said shelving track; and, c. means for biasing said pusher plate forward of said shelving track so that when positioned in said channel between said pusher plate and said front end of said shelving track, said pusher plate is adapted to allow articles to be automatically fed one after another toward said front end as leading articles in said channel successively are removed from said channel.

19. A pusher unit for dispensing merchandise having a bottom surface and at least one upstanding side surface, comprising:

a. an elongated shelving track comprising a front end and a top surface for carrying the bottom surface of the merchandise;

b. a pusher plate having an upper section, a lower section and a bottom section, each of the upper and lower sections having a front surface for engaging the side surface of the merchandise, the bottom section being connected to the shelving track for movement along the shelving track, the lower section extending upward from the bottom section, wherein the front surfaces of the pusher plate are adapted to engage the side surface of the merchandise such that the merchandise is disposed between the pusher plate and the front end of the shelving track;

c. means interconnecting the upper and lower sections of the pusher plate so that the upper section is movable between a merchandise-dispensing position and a merchandise-loading position, the front surfaces of the pusher plate being oriented such that when the upper section is in the merchandise-dispensing position, the front surface of the lower section and the front surface of the upper section define a plane, and when the upper section is in the merchandise-loading position, the front surface of the upper section of the pusher plate is out of said plane; and d. means for biasing the pusher plate toward the front end of the track to dispense merchandise.

20. The pusher unit of claim 19, wherein the interconnecting means comprises a hinge to permit the upper section of the pusher plate to selectively fold away from the front end of the shelving track.

21. The pusher unit of claim 19, wherein the upper section of the pusher plate is disposed away from the front end of the shelving track when the pusher plate is in the merchandise-loading position.

22. The pusher unit of claim 19, wherein the biasing means comprises a first end and an opposed second end, the first end being attached to the front end of the shelving track and the pusher plate being disposed between the first and second ends, whereby the pusher plate is biased toward the front end of the shelving track to dispense merchandise.

23. The pusher unit of claim 19, wherein the lower section of the pusher plate further comprises a rear surface opposite the front surface, and wherein the biasing means comprises a roll spring having opposed first and second ends and a coiled body portion therebetween, the coiled body portion having an exterior surface, wherein the first end of the roll spring is secured to the shelving track adjacent the front end thereof and wherein the exterior surface of the coiled body portion of the roll spring engages the rear surface of the lower section of the pusher plate so as normally to urge the pusher plate toward the front end of the shelving track to dispense merchandise.

24. The pusher unit of claim 19, wherein the elongated shelving track further comprises opposed longitudinal side edges, and the bottom section of the pusher plate comprises a pair of inwardly directed and opposed channel members disposed thereon adapted to receive therein the side edges of the shelving track so as to allow the pusher plate to slide along the length of the shelving track.

25. The pusher unit of claim 19, further comprising a means for selectively locking the pusher plate in a biased position along the shelving track to facilitate loading merchandise on the shelving track in front of the pusher plate.

26. The pusher unit of claim 19, wherein the shelving track further comprises a rear end opposite the front end, and further comprising means extending transversely across the elongated shelving track at an intermediate location between the front end and the rear end for weakening the shelving track whereby the shelving track can be broken along the weakening means into separate front and rear portions.

* * * * *

UNITED STATES PATENT AND TRADEMARK OFFICE

CERTIFICATE OF CORRECTION

PATENT NO. : 5,562,217

DATED : October 8, 1996

INVENTOR(S): Gerald O. Salveson; Bernard Primiano, Edmond B. Reinagel and Dennis E. Parham

It is certified that error appears in the above-identified patent and that said Letters Patent is hereby corrected as shown below:

Column 7, line 7, "from" should read --front--.

Signed and Sealed this

Sixth Day of May, 1997

*Attest:*

Bruce Lehman

BRUCE LEHMAN

*Attesting Officer*

*Commissioner of Patents and Trademarks*